US009546330B2

(12) United States Patent
Koseoglu et al.

(10) Patent No.: US 9,546,330 B2
(45) Date of Patent: Jan. 17, 2017

(54) INTEGRATED EBULLATED-BED PROCESS FOR WHOLE CRUDE OIL UPGRADING

(71) Applicant: Saudi Arabian Oil Company, Dhahran (SA)

(72) Inventors: Omer Refa Koseoglu, Dhahran (SA); Alain Paul Ranc, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 324 days.

(21) Appl. No.: 13/886,580

(22) Filed: May 3, 2013

(65) Prior Publication Data

US 2013/0292299 A1 Nov. 7, 2013

Related U.S. Application Data

(60) Provisional application No. 61/642,784, filed on May 4, 2012.

(51) Int. Cl.

| | |
|---|---|
| ***C10G 65/12*** | (2006.01) |
| ***C10G 47/00*** | (2006.01) |
| ***C10G 45/12*** | (2006.01) |
| ***C10G 45/02*** | (2006.01) |

(52) U.S. Cl.

CPC ..... *C10G 65/12* (2013.01); *C10G 45/02* (2013.01); *C10G 47/00* (2013.01); *C10G 2300/42* (2013.01)

(58) Field of Classification Search

CPC ..... C10G 2300/42; C10G 45/02; C10G 45/20; C10G 47/00; C10G 65/12

See application file for complete search history.

(56) References Cited

U.S. PATENT DOCUMENTS

| | | | | |
|---|---|---|---|---|
| 2,738,964 | A * | 3/1956 | Binder et al. | 261/114.1 |
| 2,987,465 | A | 6/1961 | Johanson | |
| 3,151,060 | A | 9/1964 | Garbo | |
| 3,617,524 | A | 11/1971 | Conn | |
| 3,645,887 | A * | 2/1972 | William | 208/96 |
| 6,436,279 | B1 | 8/2002 | Colyar | |

(Continued)

FOREIGN PATENT DOCUMENTS

| | | |
|---|---|---|
| JP | 2001-055585 A | 2/2001 |
| WO | 2009058785 A2 | 7/2009 |

OTHER PUBLICATIONS

PCT Application No. US2013/039423, nternational Search Report and Written Opinion, Sep. 9, 2013, 11 pages.

(Continued)

*Primary Examiner* — Renee E Robinson
*Assistant Examiner* — Derek Mueller
(74) *Attorney, Agent, or Firm* — Abelman, Frayne & Schwab

(57) ABSTRACT

A system and process for upgrading a whole crude oil feed in an integrated ebullated-bed and hydrotreater is provided in which the whole crude oil is flashed into a flashed straight run distillates fraction and an atmospheric residue fraction. The atmospheric residue fraction is hydroprocessed in an ebullated-bed reaction zone, while the flashed straight run distillates fraction and the products fraction produced from the ebullated-bed reaction zone are hydrotreated in a fixed-bed reaction zone. Distillates from the hydrotreater and the unconverted residue fraction from the ebullated-bed reaction zone can be combined to produce an upgraded synthetic crude oil.

9 Claims, 1 Drawing Sheet

(56) References Cited

U.S. PATENT DOCUMENTS

| | | | | |
|---|---|---|---|---|
| 7,279,090 | B2 | 10/2007 | Colyar et al. | |
| 7,901,569 | B2 | 3/2011 | Farshid et al. | |
| 2009/0139902 | A1 | 6/2009 | Kressmann et al. | |
| 2010/0018904 | A1 | 1/2010 | Kressmann et al. | |
| 2010/0025291 | A1 | 2/2010 | Shafi et al. | |
| 2010/0025293 | A1 | 2/2010 | Kressmann et al. | |
| 2011/0083996 | A1 | 4/2011 | Shafi et al. | |
| 2011/0198265 | A1* | 8/2011 | Colvar et al. | 208/56 |
| 2011/0226666 | A1 | 9/2011 | Koseoglu et al. | |

OTHER PUBLICATIONS

"The hydroconversion of residues", Encyclopedia of Hydrocarbons, vol. II, pp. 309-323, 2007.

"Axens hydrocracking—Excellence from innovation and experience", Axens, Dec. 31, 2011, 12 pages.

Joni Kunnas, et al., "Improving residue hydrocracking performance", PTQ, Q3, 2011, pp. 49-57.

J. Kunnas, et al., "Mitigate fouling in ebullated-bed hydrocrackers", Hydrocarbon Processing, Oct. 2010, 6 pages.

"Clarifying the Scope of Petroleum Hazardous Waste Listings: Supplemental Information Regarding Petroleum Hydroprocessing Units", Science Applications International Corporation, Jun. 2001, 49 pages.

Rana, et al., "A review of recent advances on process technologies for upgrading of heavy oils and residua", ScienceDirect, Fuel 86, 2007, pp. 1216-1231.

JP 2015-510472, Office Action dated Oct. 18, 2016, 14 pages.

* cited by examiner

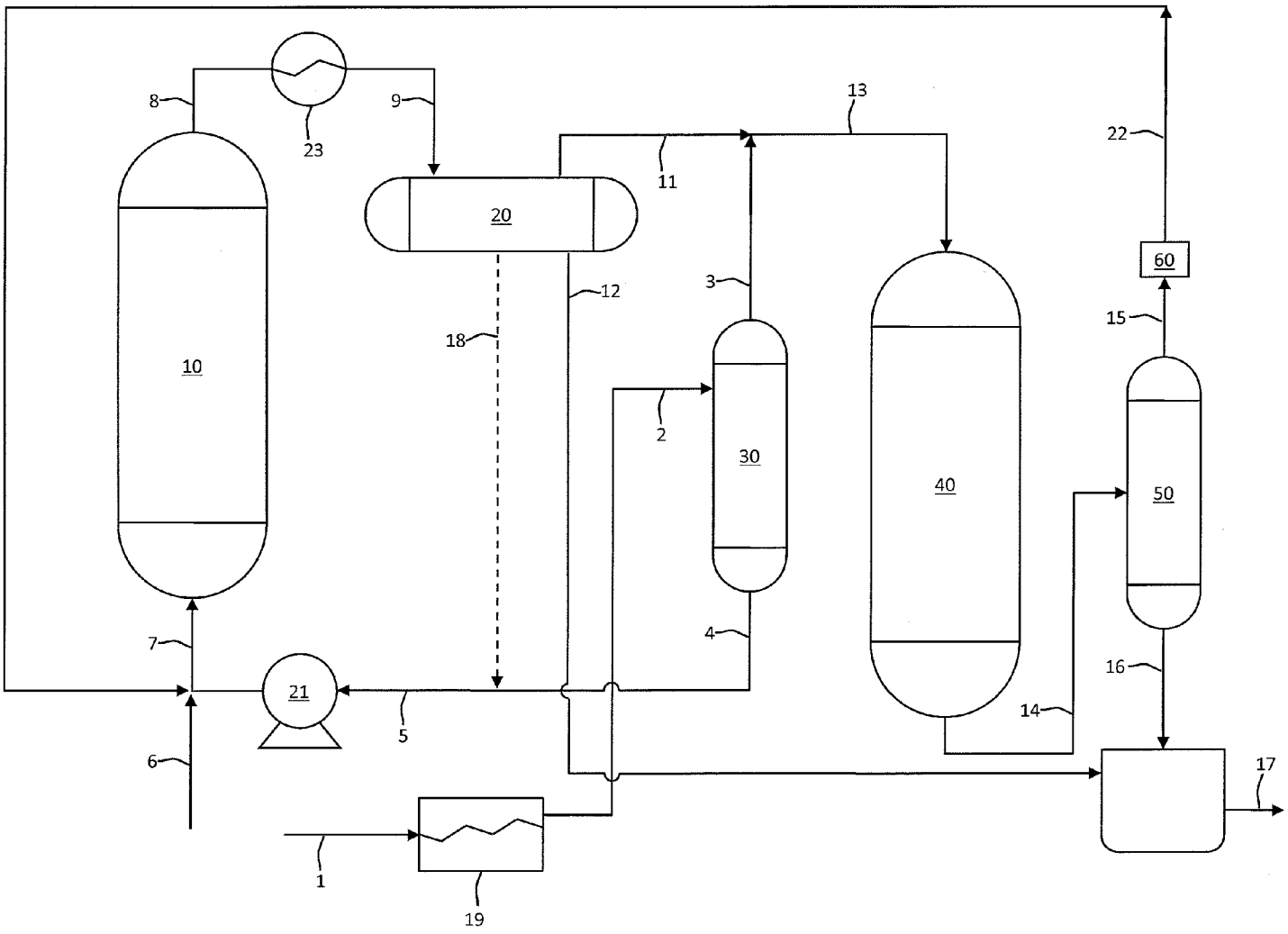
10
20
30
40
50
60
1
2
3
4
5
6
7
8
9
11
12
13
14
15
16
17
18
19
21
22
23

INTEGRATED EBULLATED-BED PROCESS FOR WHOLE CRUDE OIL UPGRADING

RELATED APPLICATIONS

This application claims the benefit of U.S. Provisional Patent Application No. 61/642,784 filed May 4, 2012, the disclosure of which is hereby incorporated by reference.

FIELD OF THE INVENTION

This invention is directed to a process to upgrade the quality of whole crude oil.

BACKGROUND

Crude oil is conventionally processed by distillation followed by various cracking, solvent treatment and hydroconversion processes to produce a desired slate of fuels, lubricating oil products, chemicals, chemical feedstocks and the like. An example of a conventional refinery process includes distillation of crude oil in an atmospheric distillation to recover gas oil, naphtha, gaseous products, and an atmospheric residuum. Streams recovered from crude distillation at the boiling point of fuels have customarily been used directly as fuels. Generally, the atmospheric residuum is further fractionated in a vacuum distillation unit to produce a vacuum gas oil and a vacuum residuum. The vacuum gas oil is commonly cracked to provide more valuable light transportation fuel products in a fluid catalytic cracking unit or by hydrocracking. The vacuum residuum can be further treated for conversion to more valuable products. For example, vacuum residuum upgrading processes can include one or more of residuum hydrotreating, residuum fluid catalytic cracking, coking, and solvent deasphalting.

There are generally three common reactor types used in the refining industry: fixed-bed, ebullated-bed, and moving-bed. The decision to use a particular type of reactor is based on a number of criteria including the type of feedstock, desired conversion percentage, flexibility, run length and product quality, among others. In a refinery, the down-time for replacement or renewal of catalyst must be as short as possible. Further, the economics of the process will generally depend upon the versatility of the system to handle feed streams containing varying amounts of contaminants such as sulfur, nitrogen, metals and/or organometallic compounds, such as those found in vacuum gas oil, deasphalted oil, and residues.

In a fixed-bed reactor, catalyst particles are stationary and do not move with respect to a fixed reference frame. Fixed-bed technologies have considerable problems in treating particularly heavy charges containing relatively high quantity of heteroatoms, metals and asphaltenes, as these contaminants cause the rapid deactivation of the catalyst and plugging of the reactor. In conventional fixed-bed reactors, the hydroprocessing catalysts are replaced regularly in order to maintain the desired level of catalyst activity and throughput. Multiple fixed-bed reactors connected in series can be used to achieve a relatively high conversion of heavy feedstocks boiling above at a cut point in the range 300-400° C., but such designs require high capital investment and, for certain feedstocks, commercially impractical, e.g., catalysts replacement every 3-4 months.

The ebullated-bed reactor was developed to overcome plugging problems commonly associated with fixed-bed reactors during processing of relatively heavy feedstocks and as the conversion requirements increases, e.g., for vacuum residue. In general, an ebullated-bed reactor includes concurrently flowing streams of liquids or slurries of liquids, solids and gas, through a vertically-oriented cylindrical vessel containing catalyst. The catalyst is placed in motion in the liquid and has a gross volume dispersed through the liquid medium that is greater than the volume of the mass when stationary. In an ebullated-bed reactor, the catalyst is in an expanded bed, thereby countering plugging problems associated with fixed-bed reactors. The fluidized nature of the catalyst in an ebullated-bed reactor also allows for on-line catalyst replacement of a small portion of the bed. This results in a high net bed activity which does not vary with time. Early ebullated-bed processes and systems are described by Johanson in U.S. Pat. Nos. 2,987,465 and 3,197,288, both of which are incorporated by reference herein.

Moving-bed reactors combine certain advantages of fixed-bed operations and the relatively easy catalyst replacement of ebullated-bed technology. Operating conditions are generally more severe than those typically used in fixed-bed reactor, i.e., the pressure can exceed 200 $Kg/cm^2$, and the temperature can be in the range of from 400° C.-430° C. During catalyst replacement, catalyst movement is slow compared to the linear velocity of the feed. Catalyst addition and withdrawal are performed, for instance, via a sluice system at the top and bottom of the reactor. The advantage of the moving-bed reactor is that the top layer of the moving-bed consists of fresh catalyst, and contaminants deposited on the top of the bed move downward with the catalyst and are released during catalyst withdrawal at the bottom. The tolerance to metals and other contaminants is therefore much greater than in a fixed-bed reactor. With this capability, the moving-bed reactor has advantages for hydroprocessing of very heavy feeds, especially when several reactors are combined in series.

Companies that develop ebullated-bed technology include: Chevron Lummus Global, Axens, Headwaters, Institut Francais du Petrole (IFP) Energies Nouvelles, Hydrocarbon Research Institute (HRI), City Services, Texaco, Hydrocarbon Technologies Inc. (HTI). The commercial names for the ebullated-bed technologies include: H-Oil, T-Star, and LC-Fining.

One major technical challenge posed when hydrotreating heavy oil fractions or whole crude oil is the effect of small concentrations of contaminants, such as, for example, organic nickel and vanadium compounds and poly-nuclear aromatic compounds. These organometallic compounds and others have been proven to reduce the activity or useful life of hydrotreating catalysts. The presence of such metal contaminants and poly-nuclear aromatics result in reduced process performance, increased capital costs and/or increased operating costs of refinery processing units. The metals in the residual fraction of the crude oil deposits on the hydroprocessing catalyst and results in catalyst deactivation. The poly-nuclear aromatic compounds are coke precursors and at high temperatures form coke, which also causes catalyst deactivation.

Conventional methods are limited in their efficacy for processing of whole crude oil feeds. For example, fixed-bed reactors require shut-down for catalyst unloading and replacement. This reduces the on stream factor and as a result increases the processing costs of the hydroprocessing units.

It is therefore desirable to provide an improved system and a process for efficient treatment of a whole crude oil to upgrade its quality.

SUMMARY OF THE DISCLOSURE

An integrated system and process for upgrading a whole crude oil feedstock is provided to reduce the content of undesired heteroatom compounds containing metals, sulfur and nitrogen. The process comprises heating a crude oil feedstock; flashing the heated feedstock to produce a flashed straight run distillate fraction and an atmospheric residual fraction; hydroprocessing the atmospheric residual fraction in an ebullated-bed reaction zone in the presence a first catalyst system, e.g., an ebullated-bed reactor catalyst, produce an ebullated-bed reactor effluent; separating the ebullated-bed reactor effluent into hydroprocessed product also containing hydrogen, a recycle oil fraction and an unconverted residual fraction; hydrotreating a stream composed of the hydroprocessed product and the flashed straight run distillate fraction in the presence of a second catalyst system, e.g., hydrotreating catalyst, in a hydrotreating zone to produce a hydrotreated effluent; separating the hydrotreated effluent to produce a light gas fraction and a hydrotreated distillate fraction; purifying the light gas fraction and recycling the purified light gas fraction to the ebullated-bed reaction zone as a source of hydrogen gas for hydroprocessing; and optionally recycling the recycle oil stream to the ebullated-bed reaction zone.

In the herein process, products can be recovered separately or as a mixture. For instance, in certain embodiments all or a portion of the hydrotreated distillate fraction and all or a portion of the unconverted residual fraction can be combined to produce a synthetic crude oil product. In certain embodiments, all or a portion of the hydrotreated distillate fraction can be recovered separately and all or a portion of the unconverted residual fraction can be recovered separately.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawing is included to provide illustration and a further understanding of the various aspects and embodiments. The drawing, together with the remainder of the specification, serves to explain principles and operations of the described and claimed aspects and embodiments.

BRIEF DESCRIPTION OF THE DRAWING

The foregoing summary, as well as the following detailed description will be best understood when read in conjunction with the attached drawing in which:

FIG. 1 is a schematic diagram of an integrated process of an ebullated-bed reactor and a fixed-bed reactor for the treatment of a whole crude oil.

DETAILED DESCRIPTION

The herein process employs a combination of an ebullated-bed reaction zone and a fixed-bed reaction zone to desulfurize and hydroprocess (i.e., hydrotreat and hydrocrack) a whole crude oil feedstock to form low sulfur, low aromatic fuels. The whole crude oil is heated and separated into a flashed straight run distillates fraction and an atmospheric residues fraction. The atmospheric residues fraction is hydroprocessed in the ebullated-bed reactor, while the hydroprocessed products and the flashed straight run distillates fraction are combined and hydrotreated in the in-line fixed-bed reactor. In certain embodiments the fixed-bed reactor only receives hydrogen from the ebullated-bed reactor effluents.

The crude oil feed can be desalted and volatile materials removed prior to desulfurization. A substantial portion of the crude oil feed is subjected to desulfurization in a desulfurization reaction zone. A number of reactions are expected to occur during the desulfurization process. Metal-containing components of the crude oil feed are at least partially demetallized during the desulfurization process, and nitrogen and oxygen are removed, along with sulfur, during the desulfurization process.

Yields of desirable fuel products are increased in the present process when the desulfurized crude oil product is fractionated, preferably in a multi-stage fractionation zone having atmospheric and vacuum distillation columns. Products from multi-stage distillation include a naphtha fraction, a light gas oil fraction, a vacuum gas oil fraction and a residual fraction. The naphtha fraction boiling in the range 36° C.-180° C. can be upgraded in a reforming process to produce gasoline blending components. The light gas oil fraction, generally having a boiling of less than about 370° C., can be used directly as a fuel or further hydroconverted for improved fuel properties. In the present process, the vacuum gas oil fraction is hydrocracked to increase the fuel yield and to further improve fuel properties. Single or multi-stage hydrocracking reactors can be employed. The hydrocracked products include at least one low sulfur fuel product that can be recovered during distillation of the hydrocracked products.

Accordingly, a process is provided for hydrodesulfurizing a crude oil feed in a crude desulfurization unit, separating the desulfurized crude oil and isolating a naphtha fraction, a light gas oil fraction, a vacuum gas oil fraction and a residual fraction, hydrocracking the vacuum gas oil to form at least one low sulfur fuel product; and hydrotreating the light gas oil fraction. This entire integrated process, in certain embodiments, can be conducted without the need for tank storage of intermediate products, such as a desulfurized crude oil, the light gas oil fraction, and the vacuum gas oil fraction. Since there is no required tank storage of intermediate products, these processes can be conducted without conventional cooling of the intermediate products, thus reducing the operating cost of the process. A further attribute of the present process that contributes to the reduction in capital and operating costs relates to the hydroconversion steps, including crude desulfurization, in which hydrocracking and hydrotreating are conducted using a single hydrogen supply loop.

Accordingly, an integrated refining system and process is described for processing a whole crude, or a substantial portion of whole crude, into a full range of products at high selectivities and high yields of the desired products. The integrated process utilizes a series of reaction zones, each containing a catalyst of varying composition and properties, for successively converting progressively lighter and cleaner fuel products.

The integrated process further provides a method for isolating, purifying and providing hydrogen to the various conversion reaction zones through the use of a single hydrogen isolation and pressurization unit.

The integrated process permits more efficient use of a combination of units for reaction, product isolation, hydrogen isolation and recycle, and energy usage in the preparation of fuels from a crude oil feed. In the practice of the process, a wide range of fuel oil products can be effectively prepared with a comparatively small number of reaction vessels and product recovery vessels, and with a minimum number of supporting vessel for handling hydrogen and intermediate products. As a further benefit, the process can be conducted while employing a smaller number of operators as compared to processes of the prior art.

The present process is based on the combination of crude desulfurization tailored to a wide boiling range feed, followed by distillation to form a few distillate streams, and bulk upgrading in an integrated hydrocracking/hydrotreating process to form a wide range of useful fuel and lubricating oil base stock products. The present process provides an efficient and less costly alternative to the conventional refinery practice of separating a crude oil feed into a number of distillate and residuum fractions, each of which are processed individually in similar but separate upgrading processes.

Referring now to the embodiment schematically illustrated in FIG. 1, a whole crude oil feed stream 1 is heated in a furnace 19 and the heated stream 2 is sent to a flash vessel 30 to produce a flashed straight run distillates fraction 3 and an atmospheric residue fraction 4. The atmospheric residue fraction 4 is conveyed, e.g. via an ebullating pump 21, to an ebullated-bed reaction zone 10 along with hydrogen (which can be recycle hydrogen 22 as described herein and optionally make-up hydrogen 6) in the presence of an ebullated-bed reactor catalyst where it is hydroprocessed to produce an ebullated-bed reactor effluent stream 8. Ebullated-bed reaction zone 10 can contain a single ebullated-bed reactor or multiple ebullated-bed reactors operated in series. In addition, while ebullating pump 21 is shown associated with the charge 4 to the ebullated-bed reaction zone 10, it is understood that a suitable ebullating pump can be associated with the recycle stream. In addition, the ebullated-bed reaction zone 10 can include ebullated bed reactors in which liquid is recycled internally with a recycle downcomer or in a configuration with external recycle.

The ebullated-bed reactor effluent stream 8 is typically cooled, e.g., via heat exchanger 23, and the cooled ebullated-bed reactor effluent stream 9 is separated in a separation unit 20 into a hydroprocessed product stream 11 containing hydrogen gas and material boiling in naphtha and gas oil range, an unconverted residue stream 12 and an optional recycle oil stream 18.

The hydroprocessed product stream 11 and the flashed straight run distillates fraction 3 are combined and hydrotreated in a fixed-bed hydroprocessing reaction zone 40 in the presence of a hydrotreating catalyst to produce a hydrotreated effluent 14. Fixed-bed hydroprocessing reaction zone 40 can contain a single fixed-bed reactor or multiple fixed-bed reactors operated in series. The hydrotreated effluent stream 14 is separated into a light gas stream 15 and a hydrotreated distillate stream 16 in a separation zone 50. The light gas stream 15 is purified, e.g., in a zone 60, and recycle hydrogen 22 is conveyed to the ebullated-bed reactor.

Recycle oil stream 18 is optionally recycled to the ebullated-bed reactor 10 for further processing, e.g., by combining recycle oil stream 18 with the atmospheric residue fraction from flash vessel 30 to form a combined stream 5 which is conveyed via ebullating pump 21.

In certain embodiments, all or a portion of the hydrotreated distillate stream 16 and all or a portion of the unconverted residual stream 12 can be combined to produce a synthetic crude oil product. In certain embodiments, all or a portion of the hydrotreated distillate stream 16 can be recovered separately and all or a portion of the unconverted residual stream 12 can be recovered separately.

The current process utilizes certain features of ebullated-bed reactors to enhance hydroprocessing of the crude oil. The crude oil is flashed into two fractions and each fraction is desulfurized separately: atmospheric residue in the ebullated-bed reactor and the distillates in the fixed-bed reactor. One benefit derived from the integrated system and process using two different reactor types is the overall reduction in reactor volume. It provides the flexibility and latitude for a refiner either to operate at isothroughput or to decrease the size of the reactors.

Furthermore, in the arrangement of the present process, make-up hydrogen is only used in the ebullated-bed reactor. The hydroprocessed product stream 11 from the ebullated-bed reactor includes off-gasses containing hydrogen, which serves and the reactant hydrogen in the fixed-bed reaction zone 40.

The present process uses an ebullated-bed reaction zone 10 for whole crude oil upgrading and in-line hydrogen partial pressure to upgrade the distillates in a fixed-bed reaction zone 40. Separation of distillates from whole crude oil minimizes cracking of distillates and results in higher distillate yield in downstream refinery operations. Contaminants such as metals and asphaltenes are removed and/or converted in the ebullated-bed reactor, to which catalyst is added and/or withdrawn on-line, e.g., daily or at certain throughput intervals.

The integration of dual reactors for upgrading of whole crude oil further allows for production of upgraded synthetic crude oil. Due to heavy and dirty nature of the feedstock, i.e. asphaltenes and metals contents, an ebullated-bed reactor is used to process hydrocarbons boiling above a cut point in the range 300-400° C., e.g., at or above 370° C., and distillates boiling below a cut point in the range 300-400° C., e.g., at or below 370° C., are treated in a fixed-bed reactor with the hydrogen source derived from the ebullated-bed reactor off-gas stream. The ebullated-bed reactor is a catalyst replacement system and therefore metals are removed from the whole crude oil in the ebullated bed-reactor. In addition the residue is cracked and the cracked products are also hydrotreated in the fixed-bed reactor. In an example described herein, due to residue conversion, the API gravity of Arab light whole crude oil is increased from 33.2° to 41.5°. In addition, sulfur content of the Arab light whole crude oil is reduced from 1.973 W % to 0.3 W %, a reduction of about 85%.

Operating conditions for the ebullated-bed reactor(s) include a total pressure of between about 100 bars and about 200 bars; an operating temperature of between about 350° C. and about 500° C.; a liquid hourly space velocity of between about 0.1 $h^{-1}$ and about 2.0 $h^{-1}$; a hydrogen-feed ratio of between about 700 standard liter per liter of feed and about 2,500 standard liter per liter of feed; and a catalyst replacement rate of between about 0.1 $Kg/m^3$ of feed and about 5 $Kg/m^3$ of feed.

The catalyst employed in the ebullated-bed reactor can be a catalyst capable of facilitating the desired removal and/or conversion of contaminates in the relatively heavy portion of the feed. A suitable ebullated-bed reactor catalyst generally contains 2-25 wt % of total active metals, in certain embodiments 5-20 wt % active metals; possesses a total pore volume of 0.30-1.50 cc/gm; possesses a total surface area of 100-400 $m^2/g$; and/or possesses an average pore diameter of at least 50 angstrom. Suitable active metals include those selected from the group consisting of Elements Group VIB, VIIB or VIIIB of the Periodic Table. For instance, suitable metals include one or more of cobalt, nickel, tungsten and molybdenum. The support material can be selected from the group consisting of alumina, silica alumina, silica, and zeolites.

Operating conditions for the fixed-bed reactor(s) include a total pressure of between about 100 bars and about 200 bars; an operating temperature of between about 350° C. and about 450° C.; a liquid hourly space velocity of between about 0.1 $h^{-1}$ and about 2.0 $h^{-1}$; and a hydrogen-feed ratio of between about 700 standard liter per liter of feed and about 2,500 standard liter per liter of feed.

The catalyst employed in the fixed-bed reactor can be a catalyst capable of facilitating the desired hydrotreating of the relatively light portion of the feed. A suitable fixed-bed reactor catalyst generally contains 2-25 wt % of total active metals, in certain embodiments 5-20 wt % active metals; possesses a total pore volume of 0.30-1.50 cc/gm; possesses a total surface area of 100-400 $m^2/g$; and/or possesses an average pore diameter of at least 50 angstrom. Suitable active metals include those selected from the group consisting of Elements Group VIB, VIIB or VIIIB of the Periodic Table. For instance, suitable metals include one or more of cobalt, nickel, tungsten and molybdenum. The support material can be selected from the group consisting of alumina, silica alumina, silica, and zeolites.

EXAMPLE

A sample of 1000 Kg of Arab light crude oil is heated and flashed in an atmospheric flash unit, resulting in a straight run distillates fraction and an atmospheric residue fraction. The properties of the whole crude oil and its fractions are given in Table 1.

TABLE 1

Properties of Arab light crude oil and its fractions

| Fraction | Whole Crude Oil | Distillates | Atmospheric Residue |
|---|---|---|---|
| Yield Weight % | 100.0 | 57.3 | 42.7 |
| Yield Volume % | 100.0 | 62.3 | 37.7 |
| Gravity, °API | 33.2 | 49.4 | 15.0 |
| Gravity, Specific 60/60° F. | 0.859 | 0.782 | 0.966 |
| Sulfur, W % | 1.9732 | 0.75 | 3.21 |

The atmospheric residue fraction is mixed with hydrogen and sent to an ebullated-bed reactor operating at 440° C., 160 bars of hydrogen partial pressure, liquid hourly space velocity of 0.2 $h^{-1}$, catalyst replacement rate of 0.86 Kg catalyst/$m^3$ of oil. The ebullated-bed reactor has an external recycle vessel, from which the unconverted oil is recycled back to the reactor at a recycle to feed ratio of 6.

The straight run distillates fraction from the flash vessel, the hydrotreated distillates containing hydrogen and light gases coming from the ebullated-bed unit are combined and sent to the distillate hydrotreating unit containing Ni—Mo on Alumina catalyst. No additional hydrogen was injected as the hydrogen partial pressure from the ebullated-bed unit is sufficient for hydrotreating reactor. The hydrotreater was operated at 380° C., liquid hourly space velocity of 1 $h^{-1}$. The hydrotreated distillates and unconverted atmospheric residue are combined to produce a synthetic crude oil with API gravity of 41.5° and sulfur content of 0.31 W %. The total API gravity improvements is 8 degrees while 85 W % of sulfur is removed from the crude oil. This result in a substantial premium for the crude oil produced. The process material balance is given in Table 2.

TABLE 2

Material Balance

| Stream Name | Stream # | Flow, Kg/h | Density, Kg/L | API Gravity, ° | Sulfur, ppmw |
|---|---|---|---|---|---|
| Whole Crude Oil | 1 | 1,000 | 0.859 | 33.1 | 19,732 |
| Heated Whole Crude Oil | 2 | 1,000 | 0.859 | 33.1 | 19,732 |
| Distillates | 3 | 623 | 0.782 | 49.4 | 10 |
| Atmospheric Residue (AR) | 4 | 377 | 0.966 | 15.0 | 32,100 |
| AR + External Recycle | 5 | 2,639 | 1.031 | 5.7 | 12,000 |
| Make-up Hydrogen | 6 | 15 | — | — | — |
| Reactor Inlet | 7 | 2,655 | 1.031 | 5.7 | 12,000 |
| Reactor Outlet | 8 | 2,655 | 0.966 | 15 | 6500 |
| Cooled Reactor Effluent | 9 | 2,655 | 0.966 | 15 | 6500 |
| External Recycle | 18 | 2,262 | 0.966 | 15.0 | 6500 |
| Hydrocracked Products | 11 | 147 | 0.815 | 42.1 | 1,259 |
| Unconverted Residue | 12 | 245 | 0.966 | 15.0 | 12,000 |
| Hydrotreater Inlet | 13 | 770 | 0.788 | 48.0 | 643 |
| Hydrotreater Outlet | 14 | 770 | | | 10 |
| Light Gases | 15 | 39 | | | |
| Hydrotreated Distillates | 16 | 732 | 0.768 | 52.6 | 10 |
| Synthetic Crude Oil | 17 | 977 | 0.818 | 41.5 | 3,018 |

The methods and systems of the present invention have been described above and in the attached drawing; however, modifications will be apparent to those of ordinary skill in the art and the scope of protection for the invention is to be defined by the claims that follow.

The invention claimed is:

1. A method for upgrading a crude oil feed to reduce the content of undesired heteroatom compounds containing metals, sulfur and nitrogen, the method comprising:

a. heating the crude oil feed and flashing the heated crude oil feed to produce a flashed straight distillate fraction and an atmospheric residue fraction;

b. hydroprocessing the atmospheric residue fraction in an ebullated-bed reaction zone in the presence of hydrogen and an ebullated-bed reactor catalyst to produce an ebullated-bed reactor effluent stream, wherein make-up hydrogen is introduced as needed;

c. separating the ebullated-bed reactor effluent stream into a hydroprocessed products stream containing hydrogen, a recycle oil stream and an unconverted residue stream, and recovering the unconverted residue stream;

d. hydrotreating in a fixed bed hydroprocessing zone a combined stream of the hydroprocessed products stream containing hydrogen and the flashed straight run distillate fraction in the presence of a hydrotreating catalyst in a hydrotreater to produce a hydrotreated effluent, wherein hydrogen from the hydroprocessed products stream forms at least a portion of the requisite hydrogen for hydrotreating reactions;

e. separating the hydrotreated effluents to produce a light gas stream and a hydrotreated distillate stream, and recovering the hydrotreated distillate stream; and f. purifying the light gas stream and recycling the purified light gas stream to the ebullated-bed reactor as a source of hydrogen gas for hydroprocessing.

2. The process of claim 1, further comprising combining the hydrotreated distillate stream and the unconverted residue stream to produce a synthetic crude oil product.

3. The process of claim 1, further comprising recycling the recycle oil stream to the ebullated-bed reaction zone.

4. The process of claim 1, wherein the hydrogen contained in the hydroprocessed products stream is the sole source of hydrogen for hydrotreatment in the fixed bed hydroprocessing zone.

5. The process of claim 1, wherein the flashed straight run distillates contain naphtha and gas oil fraction boiling below a cut point in the range of 300° C.-400° C.

6. The process of claim 1, wherein the ebullated-bed reaction zone contains single or multiple ebullated-bed reactors operated in series.

7. The process of claim 6, wherein operating conditions for the ebullated-bed reactor(s) include a total pressure of between about 100 bars and about 200 bars;

an operating temperature of between about 350° C. and about 500° C.;

a liquid hourly space velocity of between about 0.1 h-1 and about 2.0 h-1;

a hydrogen-feed ratio of between about 700 standard liter per liter of feed and about 2,500 standard liter per liter of feed; and a catalyst replacement rate of between about 0.1 Kg/m3 of feed and about 5 Kg/m3 of feed.

8. The process of claim 1, wherein the fixed bed hydroprocessing zone contains single or multiple fixed-bed reactors operated in series.

9. The process of claim 8, wherein operating conditions for the fixed-bed reactor(s) include a total pressure of between about 100 bars and about 200 bars;

an operating temperature of between about 350° C. and about 450° C.;

a liquid hourly space velocity of between about 0.1 h-1 and about 2.0 h-1; and a hydrogen-feed ratio of between about 700 standard liter per liter of feed and about 2,500 standard liter per liter of feed.

* * * * *